United States Patent [19]

Hartley

[11] 4,185,819

[45] Jan. 29, 1980

[54] INFLATABLE HOPPING GAME DEVICE

[76] Inventor: Larry W. Hartley, 424 7th Ave., Santa Cruz, Calif. 95062

[21] Appl. No.: 777,132

[22] Filed: Mar. 14, 1977

[51] Int. Cl.[2] ..... A63B 67/00

[52] U.S. Cl. ..... 273/1 A; 273/106 B

[58] Field of Search ..... 273/1 A, 136 GA, 136 G, 273/31, 118 R; 46/87; 404/10, 11; 52/102, 2

[56] References Cited

U.S. PATENT DOCUMENTS

| | | | |
|---|---|---|---|
| 2,891,793 | 6/1959 | Mudry | 273/1 A |
| 2,943,858 | 7/1960 | Slater | 273/118 R |
| 3,014,723 | 12/1961 | Butler | 273/1 A X |
| 3,052,054 | 9/1962 | Littleton et al. | 52/2 X |
| 3,115,340 | 12/1963 | Stasiuk | 273/1 A |
| 3,136,545 | 6/1964 | Stokes | 273/1 A |
| 3,163,419 | 12/1964 | Lemelson | 46/87 X |
| 3,190,657 | 6/1965 | Johnson | 273/1 A X |
| 3,206,892 | 9/1965 | Telkes et al. | 52/2 X |
| 3,800,735 | 4/1974 | Simpson | 52/2 X |
| 3,836,151 | 9/1974 | Bowerman | 273/136 GA X |
| 3,994,102 | 11/1976 | Johnson et al. | 52/2 |

*Primary Examiner*—Paul E. Shapiro
*Attorney, Agent, or Firm*—David B. Harrison

[57] ABSTRACT

A unitary construction of flexible plastic defining a plurality of interconnected, inflatable airtight tubes is disclosed. When inflated to effective rigidity, the construction may be placed on a playing surface and thereupon figures a series of compartments enabling players to engage in a hopscotch game. Clips of differing colors may be provided to hold the construction in a small package when uninflated and to provide markers for the players during the game.

8 Claims, 11 Drawing Figures

INFLATABLE HOPPING GAME DEVICE

BACKGROUND OF THE INVENTION

The present invention relates to game apparatus, and it more particularly relates to an inflatable compartment defining grid work for a hopscotch game.

Hopscotch is perhaps one of the oldest of the games known to man. It is a children's game in which each player casts a small marker into one of several compartments of a figure marked on the ground or pavement and then hops from one compartment to another, picking up the marker or kicking it. The figures have been drawn with a stick on sand, and marked with chalk upon paved surfaces.

For play areas which are not easily marked with a distinct figure, such as lawns, etc., proposals have been made in the prior art for collapsing grids of end-hinged or otherwise joined rigid segments. A drawback of those devices was the relatively large, cumbersome and heavy package into which they collapsed. Also, they were apt to lie above uneven ground surfaces and in those conditions presented a tripping hazard to the players. Further, the rigid segments were unyielding, even when lying perfectly flat upon the playing surface, and presented a tripping hazard in the event a player's foot caught a segment as the game was being played.

SUMMARY OF THE INVENTION WITH OBJECTS

One object of the present invention is to provide an inflatable hopscotch grid which overcomes the limitations and drawbacks of the prior art.

Another object of the present invention is to provide a resilient and yielding grid work for hopscotch that enables the game to be played upon a wide variety of different types of surfaces yet presents a minimum tripping hazard to the players.

A further object of the present invention is to provide a hopscotch grid that collapses into a very small package for ease in handling and storage and which is retained in a small package by a series of clips which are used as markers while the game is being played.

These and other objects and advantages are accomplished by a unitary construction of flexible, brightly colored plastic which is provided in a form defining a plurality of interconnected, airtight tubes. When the tubes are inflated, the construction becomes effectively rigid, for placement upon a playing surface and thereupon figures a series of compartments enabling the players to engage in a hopscotch game. The construction may be inflated by a fluid material such as air or water to effective rigidity, and it includes a valve which retains the inflating material therewithin during usage and expells the material to collapse the construction into a small package for carrying and storage when not in use. The construction may be provided with a series of clips of various colors, which hold it in a small package when uninflated, and which serve as playing markers for players to throw into the compartments when the construction is inflated.

Other objects, advantages and features of the invention will become apparent from the following detailed description of a preferred embodiment presented in conjunction with the accompanying drawings.

DETAILED DESCRIPTION OF THE PREFERRED EMBODIMENT

Figure 1:
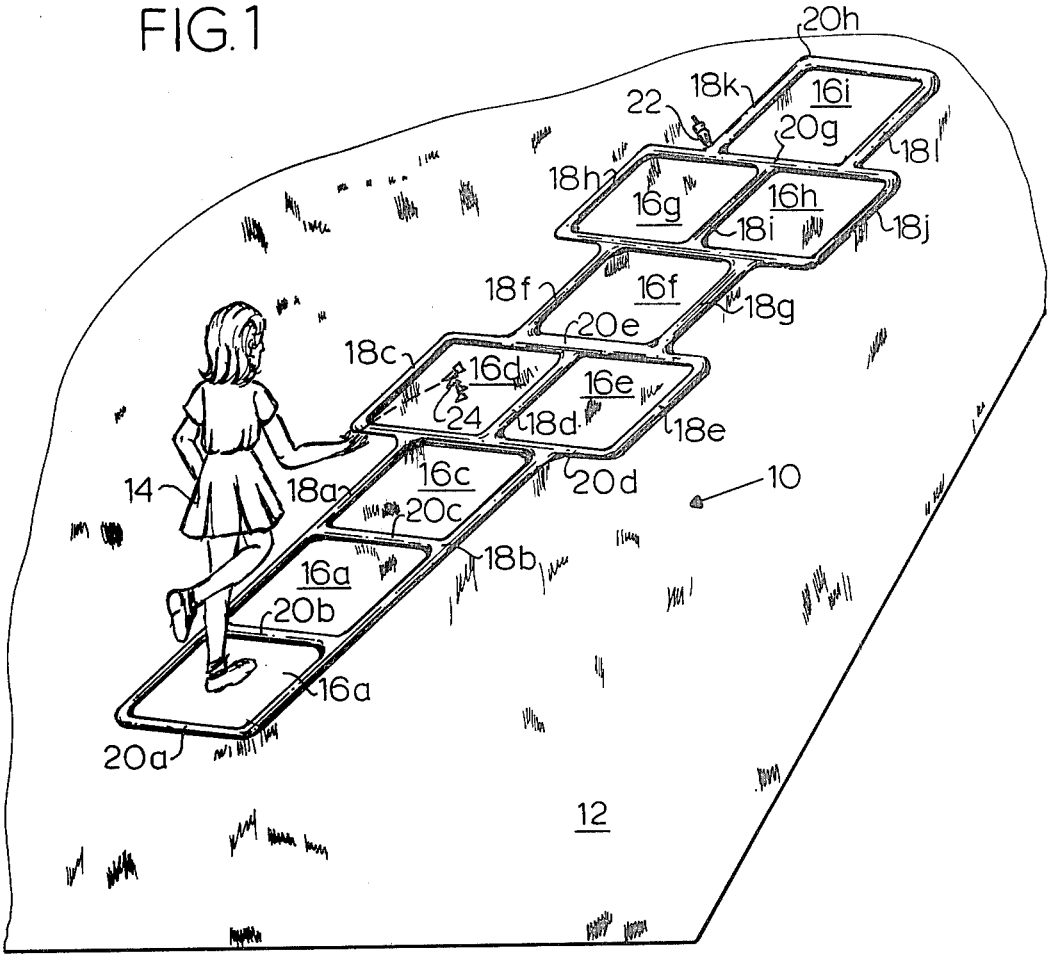
FIG. 1 is a view in perspective of a hopscotch device of the present invention which has been inflated and is in use during a game of hopscotch.

An inflatable hopscotch grid 10 made in accordance with the principles of the present invention is shown in FIG. 1. Therein, the grid 10 is shown in an inflated state and lying upon the ground 12. A child 14 is shown in the process of hopping into compartment 16 defined by the grid 10. In the example pattern shown in FIG. 1, there are nine compartments 16*a*, 16*b*, 16*c*, 16*d*, 16*e*, 16*f*, 16*g*, 16*h* and 16*i*. The pattern of the grid 10 is exemplary and is in no sense limiting, there being many other patterns utilized to play many varieties of hopscotch. Consequently, the principles of the present invention apply equally to other patterns for grids as well as the pattern shown in FIG. 1.

The grid 10 is made up of a pattern of interconnected airtight tubes, there being longitudinal tubes 18 and transverse tubes 20. Two longitudinal tubes 18*a* and 18*b*, four transverse tubes 20*a*, 20*b*, 20*c* and 20*d* make up the compartments 16*a*, 16*b* and 16*c*. Longitudinal tubes 18*c*, 18*d* and 18*e* together with transverse tubes 20*d* and 20*e* make up compartments 16*d* and 16*e*. Two longitudinal tubes 18*f* and 18*g* and two transverse tubes 20*e* and 20*f* make the compartment 16*f*, and the transverse tube 20*f* with the transverse tube 20*g* as well as longitudinal tubes 18*h*, 18*i* and 18*j* make up the two compartments 16*g* and 16*h*. The remaining compartment 16*i* is defined by two longitudinal tubes 18*k* and 18*l* and by two transverse tubes: the tube 20*g* and a tube 20*h*. A valve 22 is provided at the intersection of the tubes 18*k* and 20*g* and enables the grid 10 to be inflated.

Figure 3A:
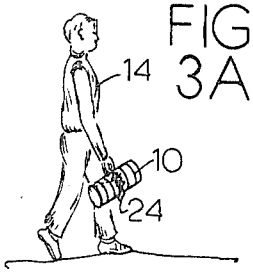
FIG. 3A is a diagrammatic view in perspective showing a child carrying the device of FIG. 1 in a fully deflated, rolled up package for ease of handling.

In typical conditions, the grid 10 is inflated by blowing air through the valve 22 until it becomes effectively rigid to define the compartments 16. This procedure is shown generally in the series of diagrams found in FIGS. 3A, 3B and 3C. In FIG. 3A, the grid 10 is shown rolled up in a small cylinder bound about the central portion by a chain of linked marking members 24. The marking members are useful to hold the deflated grid 10 in a small package for transportation, and may be detached from one another and used as throws by the children as shown in FIG. 1.

Figure 3B:
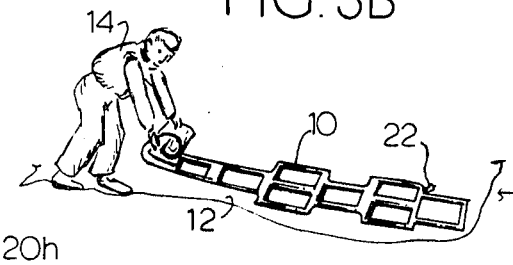
FIG. 3B is a diagrammatic view in perspective showing the child unrolling the FIG. 3A device onto the playing surface.
Figure 3C:
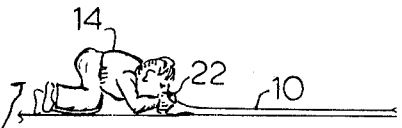
FIG. 3C is a diagrammatic view in perspective showing the child inflating the FIG. 3A device by blowing air through a valve opening.
Figure 2:
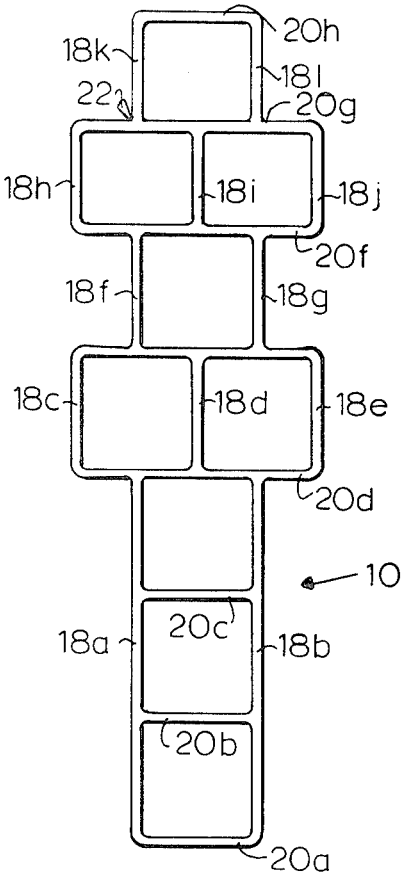
FIG. 2 is a top plan view of the device shown in FIG. 1.

Once the chain of throws 24 is removed, the grid is unwound upon the ground 12 as shown in FIG. 3B. Then, in accordance with FIG. 3C, the child blows air through the valve 22 into the construction 10 until it takes on the geometry requisite to playing the hopscotch game. In conditions of high wind, or where it is desired to hold the grid 10 permanently in place, it may be inflated by introduction of a liquid such as water therewithin. A combination of water and air may be useful in some situations.

To deflate the grid 10 for removal and storage, the valve 22 is opened, and the grid 10 is rolled up beginning at the end opposite the valve. It has been found advantageous to place the valve at one end of the grid or another rather than in the middle so that in the deflation operation, simply rolling up from one end has the effect of purging the inflating fluid completely out of the grid 10 as it is rolled up. One form of valve is shown in FIG. 7 and described in connection therewith.

Figure 4A:
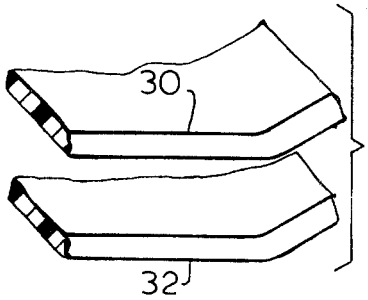
FIG. 4A is an exploded fragmentary view in perspective of a segment of the device of FIG. 1.
Figure 4B:
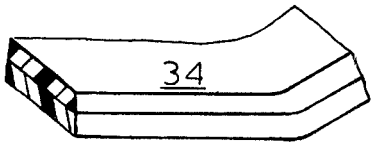
FIG. 4B is a view in perspective of the unexploded segment shown in FIG. 4A.
Figure 5:
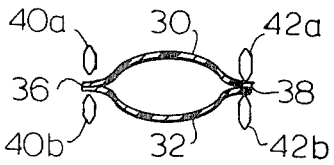
FIG. 5 is a diagrammatic view in end elevation and section of seaming apparatus in the process of edge seaming a segment of the device of FIG. 1.
Figure 6:
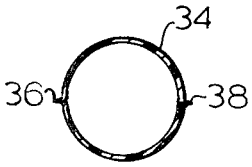
FIG. 6 is a view in section of the device of FIG. 1 taken along the line 6—6 in FIG. 2.

One form of construction of the grid 10 is shown in FIGS. 4, 5 and 6. In this form, the grid is cut from overlaid layers 30 and 32 of plastic material such as low density polyethylene, each sheet of a thickness that provides a durable product, a thickness of approximately 10 mills works well. The layers 30 and 32 are brought into registration to form a laminar structure 34 which is seamed along opposite edges 36 and 38, for example by thermoplastic welding. The welding may be accomplished by heat imparting elements 40 and 42 of a jig. Each element 40,42 includes an upper part 40*a*, 42*a* and a lower part 40*b*, 42*b* in planar alignment therewith. The laminar structure 34 is placed between the elements 40 and 42, and heat applied by the elements to the seams 36 and 38 fuses them into a single plastic mass at each seam. Thus, in FIG. 6, the structure 34 is shown in its fully inflated, airtight geometry with seams 36 and 38 protruding in opposite directions at the periphery thereof.

Figure 7:
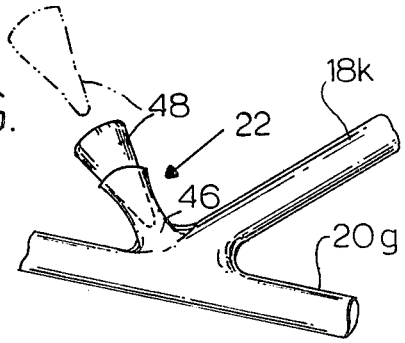
FIG. 7 is a fragmentary view in perspective of a valve used with the device of FIG. 1.

A valve construction 22 is shown in the enlarged perspective view of FIG. 7. Therein, the valve is shown to include a stem 46 which communicates with the interior of the grid 10, for example at the upper left corner thereof being the intersection of the tubes 18*h* and 20*g*. The stem 46 is stopped by a plug 48 which is slightly tapered and fits closely within the inside diameter of the stem 46 to stretch it slightly and thereby seal the inflating fluid against escape. Removal of the plug 48 allows the fluid to pass in and out of the interior of the grid 10 via the stem 46.

Figure 8:
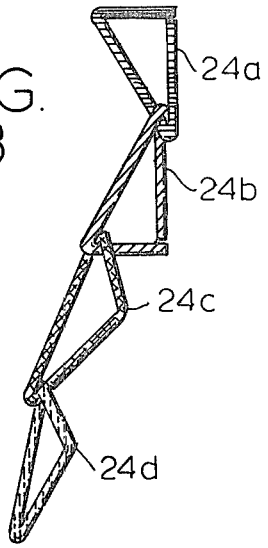
FIG. 8 is a diagrammatic view in perspective of a series of snap linked throwing members, used in conjunction with the device of FIG. 1.

A chain of four links of throws 24 is shown in the enlarged perspective view of FIG. 8. Each link 24 is shown to be formed of a small plastic rod bent into a triangular shape with the end thereof coming into close overlying proximity to define a removal location. It is preferred that the links be colored with a variety of colors being provided so that a plurality of children may each be provided with a different colored link to serve as his or her throw during the course of the game played with the grid 10. After the game is completed and the grid 10 is deflated as already explained, the throws 24 are assembled into a chain and may conveniently bind the rolled grid 10 as shown in FIG. 3A. In the example of FIG. 8, the link 24*a* is given the color of blue, the link 24*b* is colored brown, the link 24*c* is colored orange and the link 24*d* is colored purple. Colors such as green, gray and black are to be avoided so that the links are visible against a lawn or paved playing surface. Similarly, the grid 10 is preferably provided with a bright color such as red or orange so that the compartments are unmistakably defined, even to children whose sight may be partially impaired.

It will be appreciated that the grid 10 remains flexible during use and may be stepped upon without damage so long as the plastic material of which it is made is not punctured. Even in the event that a puncture occurs, a patching kit may be included with the grid 10 so that small holes may be repaired. Alternatively, an adhesively coated tape such as "Scotch" tape may be applied to repair the grid in the event that it becomes punctured.

To those skilled in the art to which this invention relates, many changes in construction and widely differing embodiments and applications of the invention will suggest themselves without departing from the spirit and scope of this invention. The disclosures and the description herein are purely illustrative and are not intended to be in any sense limiting.

I claim:

1. A hopscotch grid-providing construction comprising a series of connected air-tight tubes of plastic material which when inflated become effectively rigid and in connection define collectively said grid which may then be placed and retained directly upon a playing surface to enable hopscotch games and the like to be played therewith and further comprising a plurality of throwing markers formed as enclosed links having openable portions and linkable together into a chain for binding up said construction in a deflated condition.

2. The construction of claim 1 including fluid introduction means for enabling the interior of said construction to be inflated and valve means for holding said inflating fluid within said construction.

3. The construction of claim 2 wherein said inflating fluid is a gas.

4. The construction of claim 2 wherein said inflating fluid includes a liquid, such as water and the like.

5. The subject matter of claim 1 wherein said throwing markers are of different colors.

6. The construction of claim 1 wherein each tube of said construction comprises two overlying sheets of plastic film material which are heat-seamed at least along longitudinal edges thereof.

7. The construction of claim 6 wherein said plastic film comprises low density polyethylene film.

8. The construction of claim 1 being provided with an appearance visually clearly distinct from the playing surface upon which said construction is directly placed.

* * * * *